US012091943B2

(12) United States Patent
Cafaro

(10) Patent No.: US 12,091,943 B2
(45) Date of Patent: Sep. 17, 2024

(54) COMPLIANT WELL INSERT SLEEVES

(71) Applicant: Baker Hughes Energy Technology UK Limited, Bristol (GB)

(72) Inventor: Carlo Samuele Cafaro, Rogaland (NO)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/099,538

(22) Filed: Jan. 20, 2023

(65) Prior Publication Data

US 2023/0243242 A1 Aug. 3, 2023

Related U.S. Application Data

(60) Provisional application No. 63/306,461, filed on Feb. 3, 2022.

(51) Int. Cl.

| | |
|---|---|
| ***E21B 33/043*** | (2006.01) |
| ***E21B 41/08*** | (2006.01) |
| ***E21B 41/10*** | (2006.01) |

(52) U.S. Cl.

CPC ..... *E21B 41/10* (2013.01); *E21B 33/043* (2013.01); *E21B 41/08* (2013.01)

(58) Field of Classification Search

CPC ..... E21B 33/043; E21B 41/08

See application file for complete search history.

(56) References Cited

U.S. PATENT DOCUMENTS 3,143,172 A * 8/1964 Wakefield, Jr. ..... E21B 33/035 166/352
3,885,623 A * 5/1975 Watkins ..... E21B 7/128 166/368
4,408,932 A * 10/1983 Cowan ..... E21B 41/08 405/199
4,611,661 A * 9/1986 Hed ..... E21B 41/10 166/368
4,706,757 A * 11/1987 Harrington ..... E21B 43/017 175/7
4,822,212 A * 4/1989 Hall ..... E21B 33/043 166/359
5,069,287 A 12/1991 Short (Continued)

FOREIGN PATENT DOCUMENTS

CA 952 093 7/1974
CN 111219161 A * 6/2020

(Continued)

OTHER PUBLICATIONS

International Search Report and Written Opinion mailed May 19, 2023 in corresponding PCT Application No. PCT/EP2023/025052.

*Primary Examiner* — Matthew R Buck

(74) *Attorney, Agent, or Firm* — Baker Hughes Company

(57) ABSTRACT

A system is disclosed to enable compliance of a well insert sleeve using a guide sleeve that is associated with a wash-out hole, where the guide sleeve includes a pivot shoulder. The system includes providing the well insert sleeve with a top portion, a bottom portion, and a pivot surface, so that the pivot surface is in contact with a pivot shoulder. The top portion is at a top clearance from the guide sleeve and the bottom portion is at a bottom clearance from the guide sleeve. The features altogether enable the compliance, in an angular manner, for the well insert sleeve during assembly of well components thereon.

20 Claims, 7 Drawing Sheets

(56) References Cited

U.S. PATENT DOCUMENTS

| | | | | |
|---|---|---|---|---|
| 5,395,183 | A * | 3/1995 | Watkins | E21B 19/004 166/359 |
| 2012/0292037 | A1 | 11/2012 | Gutierrez | |

FOREIGN PATENT DOCUMENTS

| | | |
|---|---|---|
| GB | 2 226 063 | 6/1990 |
| GB | 2 589 078 | 5/2021 |

* cited by examiner

COMPLIANT WELL INSERT SLEEVES

CROSS-REFERENCES TO RELATED APPLICATIONS

This application is related to and claims the benefit of priority from U.S. Provisional Application 63/306,461, titled COMPLIANT WELL INSERT SLEEVES, filed Feb. 3, 2022, the entire disclosure of which is incorporated by reference herein for all intents and purposes.

BACKGROUND

1. Field of Invention

This invention relates in general to subsea templates in oil and gas operations, and in particular to a well insert that is compliant and that is for use with a subsea template manifold system.

2. Description of the Prior Art

Structures used in oil and gas operations may include a subsea template manifold system to simplify installation of a wellhead and a conductor therein. In at least one embodiment, subsea template manifold systems may be used in underwater installation, to collect the oil and gas production extracted from subsea wells. The collection may be passed through a flowline network that is provided to further transport extracted hydrocarbons of the collection to receiving and processing facilities located at a topside of an offshore platform or to an onshore location. The subsea template manifold system may include any of different types of subsea manifolds. Subsea wells may be directly installed within the subsea manifold.

SUMMARY

In at least one embodiment, a system to enable compliance of a well insert sleeve is disclosed. The system includes a guide sleeve within a wash-out hole. The guide sleeve can include a pivot shoulder. The system includes the well insert sleeve having a top portion, a bottom portion, and a pivot surface. The pivot surface can be in contact with the pivot shoulder of the guide sleeve. The top portion of the well insert sleeve can be at a top clearance from the guide sleeve, while the bottom portion can be at a bottom clearance from the guide sleeve. The top clearance, the bottom clearance, and the contact enable the compliance by a predetermined tilt for the well insert sleeve during assembly of components thereon.

In at least one embodiment, a system is disclosed to enable compliance of a well insert sleeve. The system includes a guide sleeve to be used with the well insert sleeve for a wash-out hole. The guide sleeve has a clearance and a contact relative to the well insert sleeve. The clearance and the contact are to enable the compliance of the well insert sleeve by a predetermined tilt relative to a vertical axis of a wash-out hole. The system includes at least one shear pin that is associated between the guide sleeve and the well insert sleeve so that the shear pin can shear upon thermal expansion of a well associated with the well insert sleeve.

In at least one embodiment, a system is disclosed to enable compliance of a well insert sleeve. The system includes a guide sleeve to be used with the well insert sleeve for a wash-out hole. The guide sleeve has a clearance and a contact relative to the well insert sleeve. The clearance and the contact are to enable the compliance of the well insert sleeve by a predetermined tilt relative to a vertical axis of a wash-out hole. The system includes a mounting plate that is provided for an Xmas tree flowline connector. The mounting plate is associated with the well insert sleeve to enable a movement that is associated with the compliance of the well insert sleeve.

In at least one embodiment, a system is disclosed to enable compliance of a well insert sleeve. The system includes a guide sleeve to be used with the well insert sleeve for a wash-out hole. The guide sleeve has a clearance and a contact relative to the well insert sleeve. The clearance and the contact are to enable the compliance of the well insert sleeve by a predetermined tilt relative to a vertical axis of a wash-out hole. The system includes a wash-out sleeve comprising a determined length to enable cement application to fixedly associate the conductor within the wash-out hole and to prevent the cement application from fixedly associating the conductor with the template structure of a subsea template manifold system.

BRIEF DESCRIPTION OF THE DRAWINGS

Various embodiments in accordance with the present disclosure will be described with reference to the drawings, in which.

DETAILED DESCRIPTION

Figure 1:
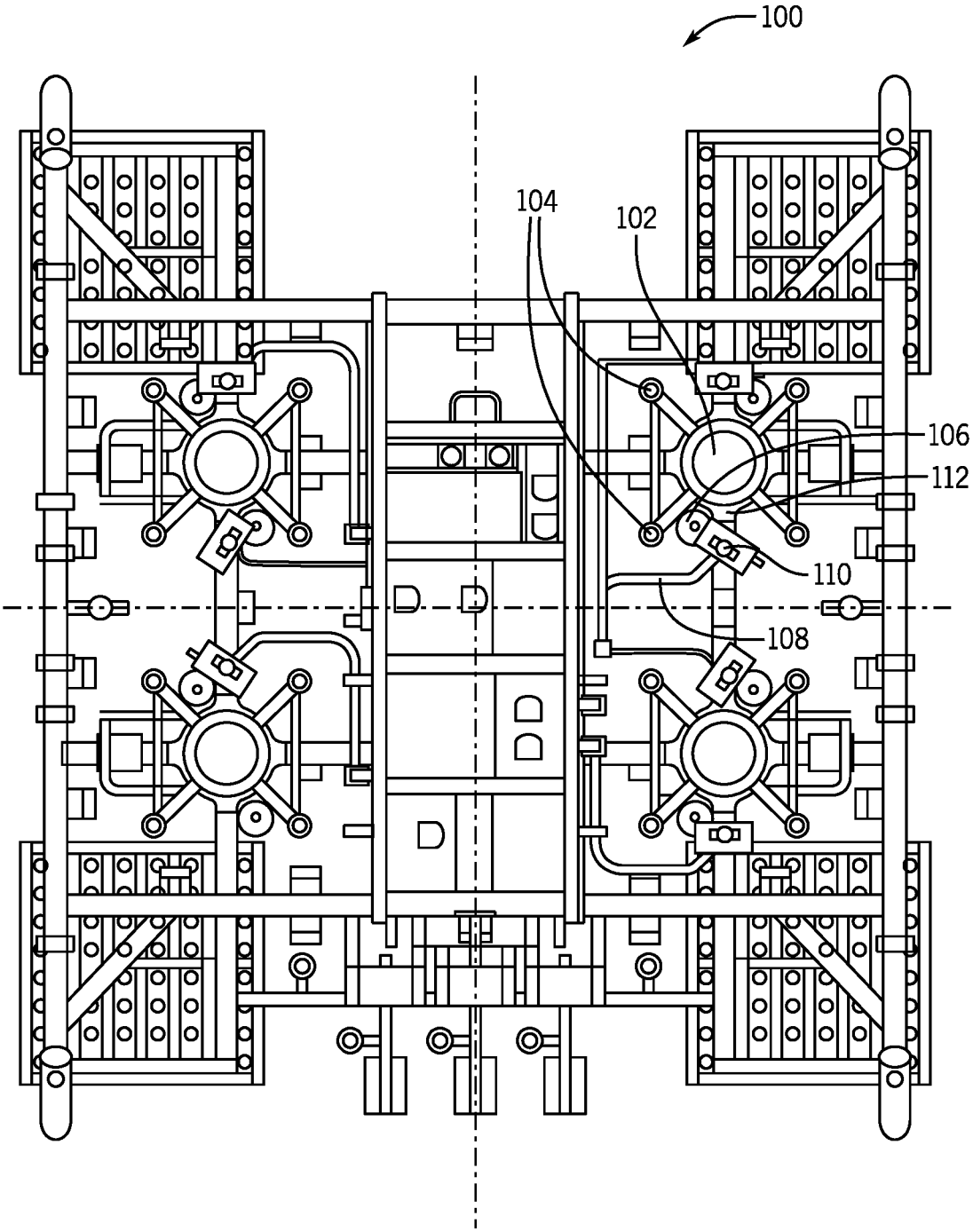
FIG. 1 illustrates an example subsea template manifold system that can be subject to aspects of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

A wellhead may be a top-end of a subsea well. A Christmas (Xmas) Tree is a device fitted to a wellhead in order to gather and control production of hydrocarbons flowing up from a well. A subsea template manifold system may accommodate several wellheads and their corresponding Xmas trees. In at least one embodiment, a subsea template manifold system may have four offsets, which accommodates four distinct wellheads and Xmas tree assemblies. Each Xmas tree may be linked to a template piping system by means of one or more subsea operable connections.

A well insert may be a mechanical device that provides a structural link between a wellhead and a template. In at least one embodiment, to ensure that the wellhead is correctly positioned for installation and is properly secured to its dedicated slot within a subsea template manifold system, various time consuming and error-prone trial-and-error procedures were previously conducted.

Conductors in a wash-out hole may be installed over a subsea template manifold system, by a specialized offshore platform, often referred to as a drilling rig. The wash-out hole is a drilled hole enabled by the drilling rig in a seabed. The drilling rig may be floating or standing over a seabed. The drilling rigs may be outfitted with different equipment required for perforating the seabed. The perforation may be to enable deployment of a conductor into the drilled hole. Care may be taken to ensure that the drilled hole is vertical and routed precisely through a well insert sleeve. This operation, however, is difficult as physical obstacles may be found along a theoretical drilling path.

Drilling technology may not be able to guarantee that a drilled hole is perfectly coaxial and parallel to a well insert sleeve. In practice, there may be always an angular misalignment between these two cylinders which may lead to an angled drilled hole. Even though the drilled hole may be tilted only a fraction of degree with respect to a well insert sleeve, such a fraction may be enough to prevent a conductor from penetrating all the way down the drilled hole. One reason may be because it is difficult to bend a conductor to fit both well insert sleeve and drilled hole. The conductor is a pipe that may be very stiff.

This problem may be furthered also by an outside diameter (OD) of a conductor being universally increased from 30 inches to 36 inches. The OD change has more than doubled the stiffness of a conductor. As a result, installations have failed, with the conductor jamming into a well insert and being unable to be set down in an intended position in a wash-out hole. Further, repeated attempts and offshore repairs may result in high economical losses, as the drilling rig is an expensive vessel to be retained for long periods of time for the installation process.

A further problem addressed herein is that due to a well's thermal expansion, a template structure of a subsea template manifold system may be subject to large upward loads, which can complicate structural design. Underestimation of this problem can result in costly repair interventions required at a later time than the installation time. Yet another problem addressed herein is a lack of proper containment for a return path of drilling mud and of filling cement, which may result in dilution of soil around a top of the conductor. Such dilution may, cause a loss of structural stability for both, a conductor and for a foundation of a subsea template manifold system.

In at least one embodiment, one or more systems or methods herein addresses issues where it may be difficult to install a wellhead with the subsea template manifold system. A well insert sleeve may be provided with a guide sleeve for locating and supporting a conductor to a precise and determined position within a slot of a subsea template manifold system. As such, instead of a well insert sleeve that is rigidly fixed to the subsea template manifold system, the well insert sleeve herein may be associated with the guide sleeve via a shear pin. This addresses problems of a lack of relative movement allowed between the guide sleeve and the subsea template manifold system. Relative movement includes relative translations and relative rotations that are, therefore, prevented.

In at least one embodiment, a well insert sleeve may be made compliant by its association with a guide sleeve. Compliance or being compliant, as used with the well insert sleeve, is to allow the well insert sleeve to move in an angular manner relative to a vertical axis of a wash-out hole. This allows the well insert sleeve to be offset from a vertical axis so that installation of components therethrough is possible without requirements for the components to bend or align to the vertical axis. The well insert sleeve may be a mechanical device, that, along with the guide sleeve, are not rigidly fixed to a template structure of a subsea template manifold system. Instead, clearances are provided in millimeters between the well insert sleeve and the guide sleeve. The clearances enable compliance of the well insert sleeve in an angular manner, such as a tilting to a certain predetermined angle. In at least one embodiment, while relative translation of a well insert sleeve, with respect to a subsea template manifold system, may be prevented, a relative angular rotation is, instead, allowed.

In at least one embodiment, a further feature enabled herein is to extend compliance of a well insert to an Xmas tree flowline connector. For example, the Xmas tree flowline connector may be directly mounted on a mounting plate that is associated with the well insert sleeve. This can address any lack of separation between an Xmas tree flowline connector and well components due to an offset of the well insert sleeve. Particularly, this can address prior contact issues from the mounting plate being associated with a template structure of the subsea template manifold system.

In at least one embodiment, a further feature enabled herein is to allow the well insert sleeve, even if compliant, to move upward to absorb thermal expansion of a well under operation, For example, shear pins may be initially used to fasten the well insert sleeve to a template structure of the subsea template manifold system. However, such shear pins may be caused to shear (such as, break and release). The shearing of the shear pins enables the well insert sleeve to move when the well expands upwards, for instance.

In at least one embodiment, a further feature enabled herein is to allow a well insert sleeve to incorporate a long wash-out sleeve. The long wash-out sleeve protrudes several meters down a wash-out or conductor hole. This facilitates suction of drill mud and facilitates cementing of the annulus between a drilled hole and the conductor. As a result, in part, from the long wash-out sleeve, cement application does not lock the conductor to the template structure of the subsea template manifold system. The conductor remains free to move upward to release any thermal expansion.

In at least one embodiment, one or more of such features enabled for a well insert sleeve enables compliance of the well insert sleeve to angular movement and can address problems of the conductor jamming inside the well insert sleeve. A result achieved by leaving the well insert sleeve free to tilt in an angular manner, is to allow automatic or forced alignment of the well insert sleeve in the drilling hole (wash-out or conductor hole), when the conductor is installed. As the conductor is stiff, instead of bending the conductor, the well insert sleeve is movable angularly to suit the well insert sleeve In at least one embodiment, a tilt allowed, under the compliant requirements for a well insert sleeve, also does not generate any detrimental effect to an installation process for the Xmas tree. For example, as both, the Xmas tree and a flowline connection hub are fitted to a well insert that is compliant, there is no relative movement between these two components. Further, as the well insert sleeve is compliant and able to slide up when the retaining pins are sheared off, no large forces are applied to a template structure of a subsea template manifold system, as a result of thermal expansion of the well. This can result in a simpler and safer structure.

In at least one embodiment, further, the long wash-out sleeve may be set at a bottom of a well insert sleeve that is compliant. This largely reduces a risk of wash out of return drilling mud and cement. This also eliminates a risk of reduced structural stability of a conductor and template foundation, while also reducing pollution.

FIG. 1 illustrates an example subsea template manifold system 100 that can be subject to aspects of at least one embodiment herein. The subsea template manifold system 100 includes four slots 102. Further the subsea template manifold system 100 includes Xmas tree guidance arms 104 and a mounting plate 106 for an Xmas tree flowline connector 110. The Xmas tree flowline connector 110 provides a flowline 108 to a flowline connection hub. FIG. 1 illustrates that the subsea template manifold system 100 has the mounting plate 106 that is fixedly attached to a template structure 112 of the subsea template manifold system 100.

Figure 2:
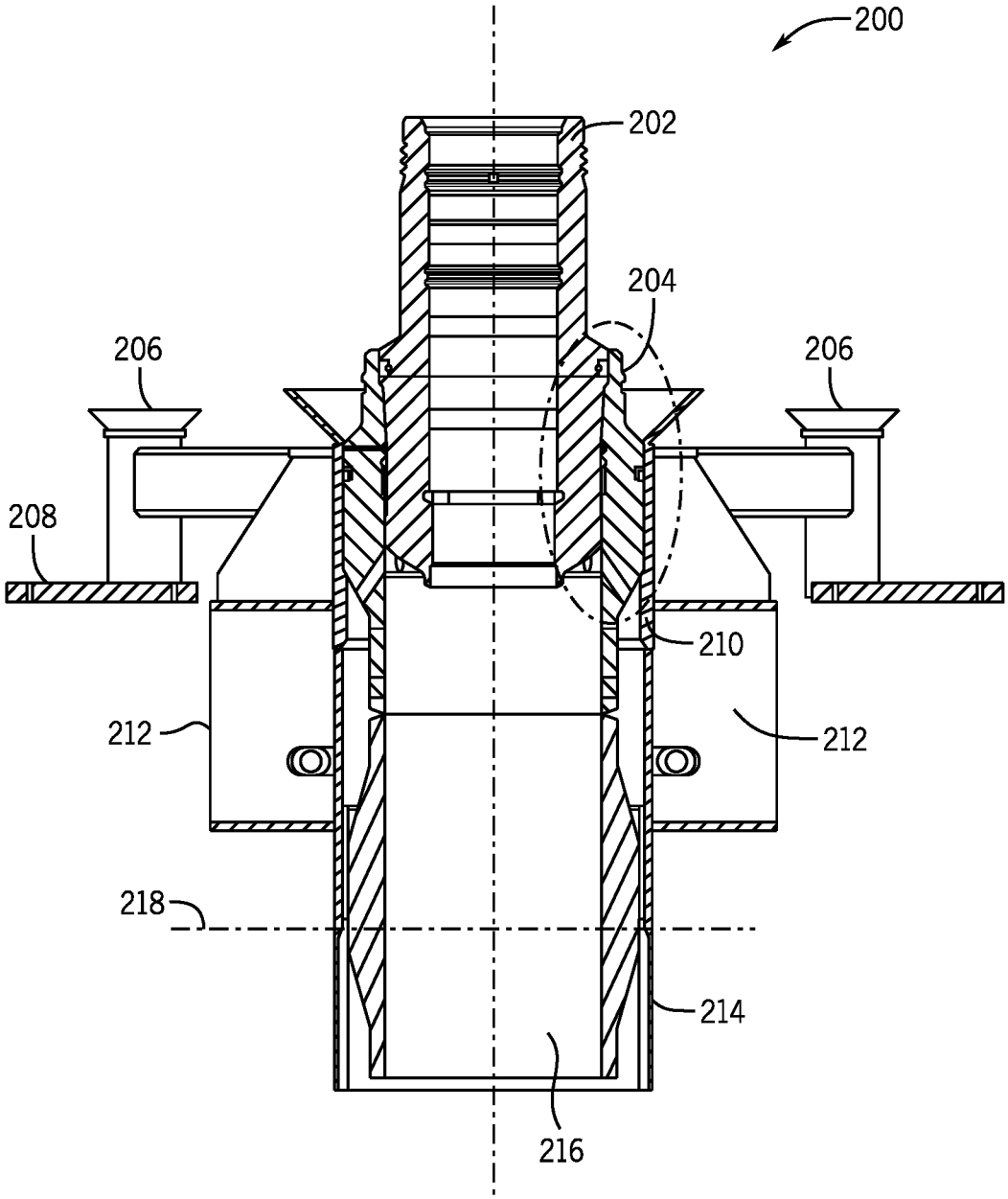
FIG. 2 illustrates a system of components for a well that can be subject to aspects of at least one embodiment herein.

FIG. 2 illustrates a system 200 of components for a well that can be subject to aspects of at least one embodiment herein. The system 200 includes a wellhead 202 fitted to a wellhead housing 204. The wellhead housing 204 is within a well insert sleeve 210 that is fixedly associated (such as, welded) to a template structure 212 of the subsea template manifold system 200. A wash-out sleeve 214 and a conductor 216 may be provided to support the wellhead housing 204. A mudline level 218 is illustrated in FIG. 2 and the conductor 216 is less than 30 meters long. to FIG. 2 also illustrates Xmas tree guiding arms or platforms 206 and a mounting plate 208 for an Xmas tree flowline connector 110. The mounting plate 208 is fixedly attached to the template structure 212, such as, by welding.

Figure 3:
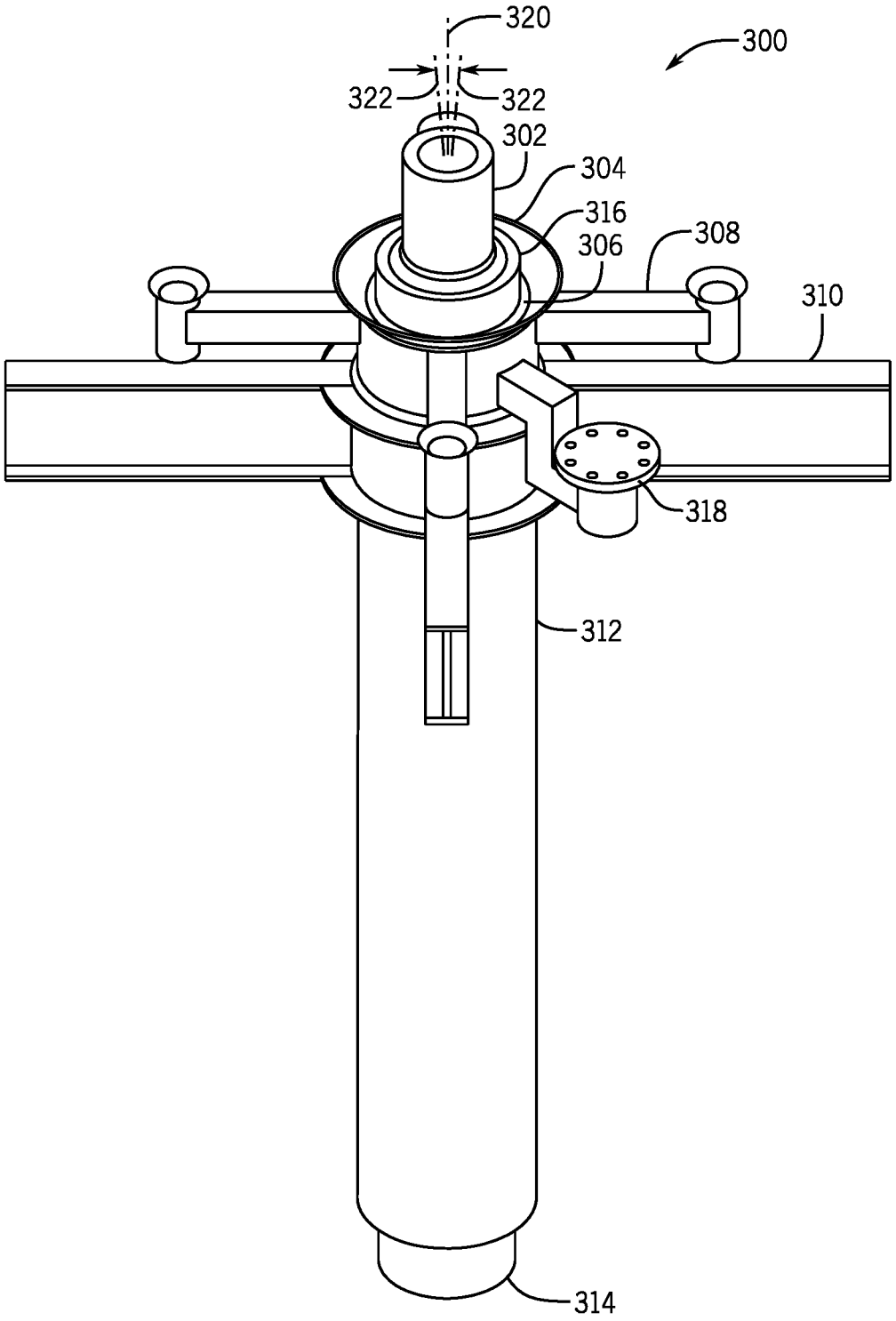
FIG. 3 is a perspective illustration of components for a well incorporating a well insert sleeve that is compliant, according to at least one embodiment.

FIG. 3 is a perspective illustration of components 300 for a well incorporating a well insert sleeve that is compliant, according to at least one embodiment. Distinct from aspects in FIGS. 1 and 2, FIG. 3 illustrates a long conductor 314 that is about 30 meters long to penetrate to as much a distinct within a drilling hole. A wash-out sleeve 312 is illustrated, along with a template structure 310. A mounting plate 318 for an Xmas tree flowline connector 110 is illustrated as movably associated with a well insert sleeve 304. As discussed herein, the well insert sleeve 304 is enabled to move in an angular manner 322 about a vertical axis 320 through a wash-out hole that includes the components 300 for the well.

Figure 4:
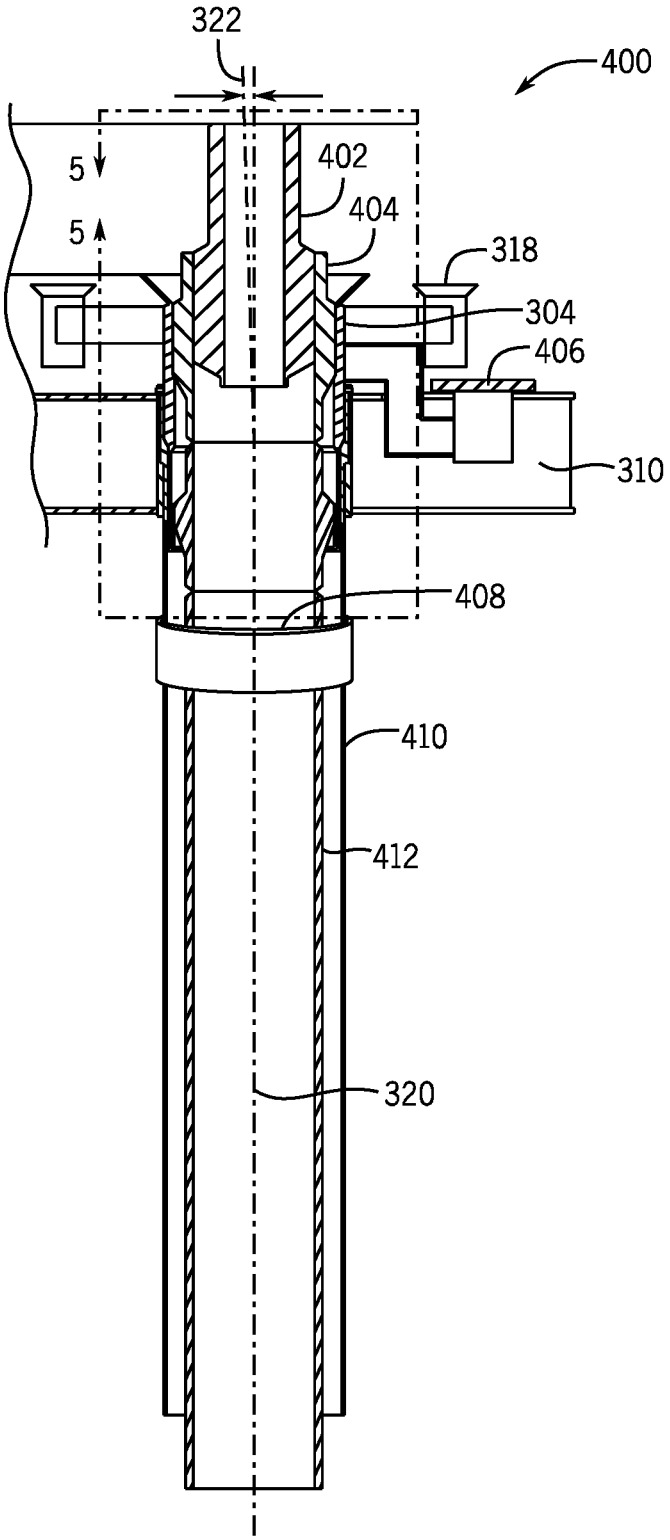
FIG. 4 is a cross-sectional illustration of components for a well incorporating a well insert sleeve that is compliant, according to at least one embodiment.
Figure 5:
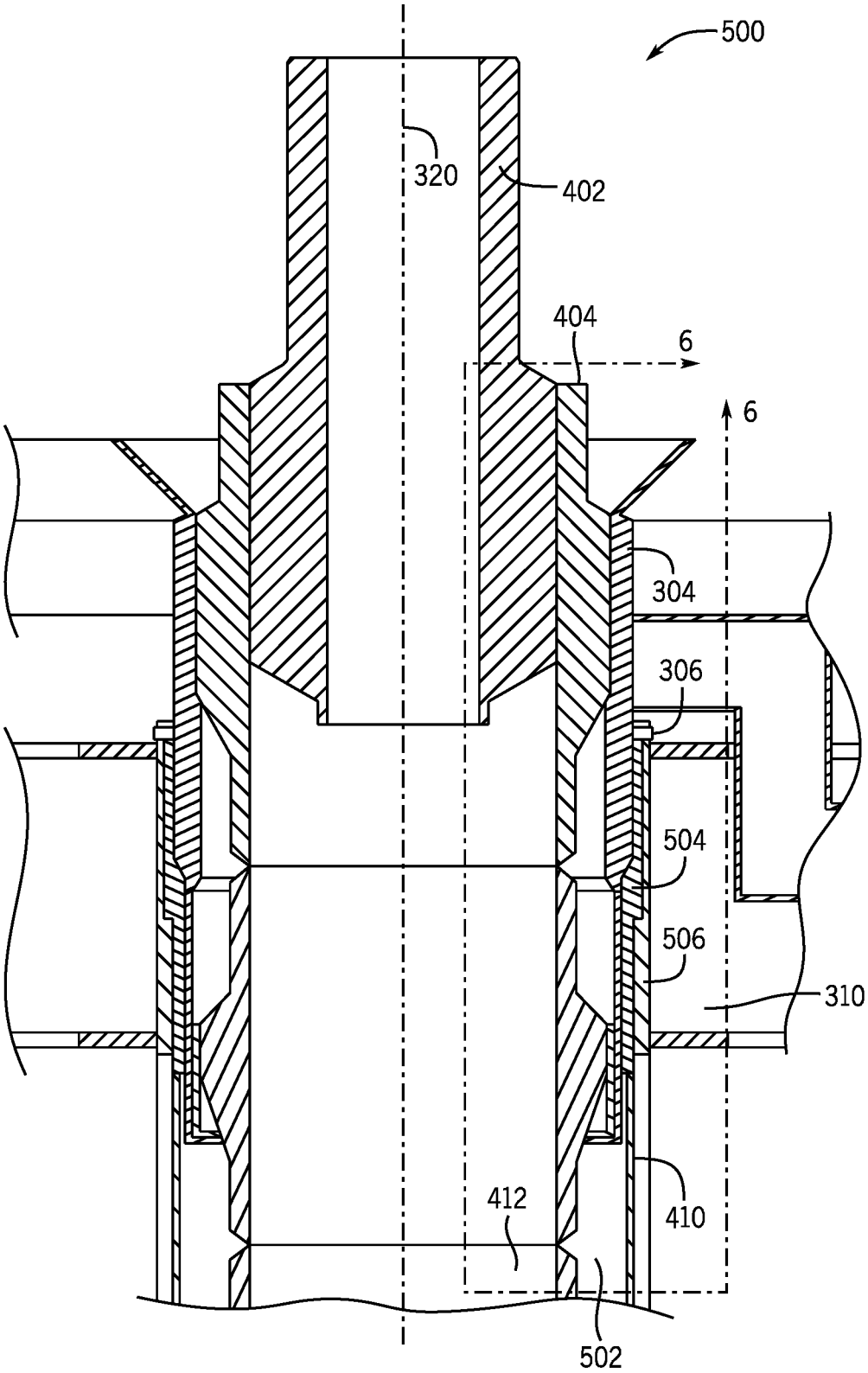
FIG. 5 is a further cross-sectional illustration of components for a well incorporating a well insert sleeve that is compliant, according to at least one embodiment.
Figure 6:
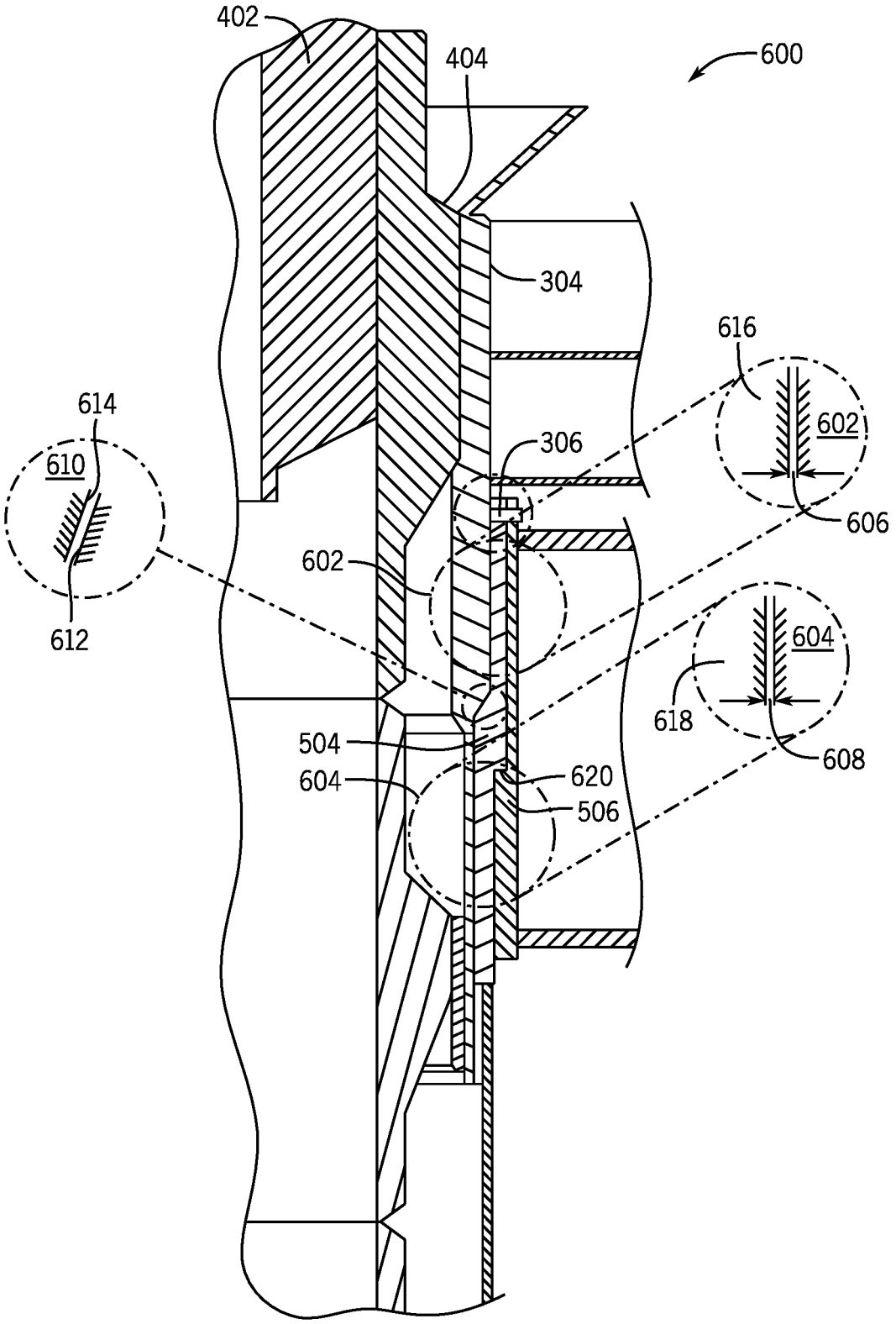
FIG. 6 is a part of a cross-sectional illustration of components for a well incorporating a well insert sleeve that is compliant, according to at least one embodiment.

At least one shear pin 306 enables the well insert sleeve 304 to be associated with a guide sleeve and may enable a further association with a mounting sleeve and with the template structure, as further described with respect to FIGS. 4, 5, and 6. In FIG. 3, a high pressure wellhead may be associated at illustrated component 302 and a low pressure component 316 may be provided within the well insert sleeve 304.

FIG. 4 is a cross-sectional illustration of components 400 for a well incorporating a well insert sleeve that is compliant, according to at least one embodiment. The components 400 include a wash-out sleeve 410 and a conductor 412 that is about 30 meters long. A wellhead 402 is illustrated as within a wellhead housing 404. The wellhead housing 404 is associated with a well insert sleeve 304 that is a compliant well insert sleeve. A mounting plate 318 is illustrated as fixed to such a well insert sleeve 304 so that it can move with the well insert sleeve in an angular 322 manner about a vertical axis 320 of a wash-out or conductor hole 408.

FIG. 5 is a further cross-sectional illustration of components 500 for a well incorporating a well insert sleeve that is compliant, according to at least one embodiment. FIG. 5 details the upper components of a well incorporating a well insert sleeve that is compliant. As illustrated in FIG. 4 and in this figure, the well insert sleeve 304, along with its connected components, such as, the wellhead 402 and the wellhead housing 404 are titled to the left with respect to a vertical axis 320 through a wash-out hole.

FIG. 5 illustrates that a shear pin 306 protrudes from a well insert sleeve 304. The shear pin 306 is associated with a guide sleeve 504. The shear pin 306 may be also associated with a mounting sleeve 506. Further, the shear pin 306 may be associated with the template structure 310. The conductor 412 may include associated sections and the wellhead housing 404 sits at the top, over which the wellhead 402 is provided. An annular area 502 between a wash-out sleeve 410 and a conductor 412 enables cement to be provided to fixedly associate the conductor within the wash-out hole.

FIG. 6 is a part of a cross-sectional illustration of components 600 for a well incorporating a well insert sleeve that is compliant, according to at least one embodiment. In FIG. 6, a system including the components 600 illustrated enables compliance of a well insert sleeve. In at least one embodiment, a guide sleeve 504 may be provided within a wash-out hole. The guide sleeve 504 includes a pivot shoulder 612. A well insert sleeve 304 includes a top portion 616 (in callout or excerpt 602), a bottom portion 618 (in callout or excerpt 604), and a pivot surface 614. The pivot surface 614 can be in contact with the pivot shoulder 612 when the well insert sleeve 304 is associated with the guide sleeve 504. The top portion 616 can at a top clearance 606 from the guide sleeve 504 and the bottom portion 618 can be at a bottom clearance 608 from the guide sleeve 504. The top clearance, the bottom clearance, and the contact enable the compliance in an angular manner for the well insert sleeve 304 during assembly of components, such as a wellhead and a wellhead housing thereon.

In at least one embodiment, a conductor may be installed with an offset, such as one or more angles 322, into a wash-out hole. The offset is from a vertical axis 320 of a wash-out hole. Further, the top clearance, the bottom clearance, and the contact between the pivot surface 614 and the pivot shoulder 612 enable the compliance of the well insert sleeve 304 to accommodate the offset.

In at least one embodiment, a wellhead housing 604 and a wellhead 402 are to be installed with a conductor. Then, one or more of the wellhead housing, the wellhead, and the conductor are to be installed with an offset into the wash-out hole. The offset is an angle 322 from a vertical axis 320 of a wash-out hole. The top clearance, the bottom clearance, and the contact between the pivot surface 614 and the pivot shoulder 612 enable the compliance of the well insert sleeve 304 to accommodate the offset.

In at least one embodiment, a mounting sleeve 506 may be provided between the guide sleeve 504 and the well insert sleeve 304. The mounting sleeve 506 can allow the guide sleeve 504 to rest thereon, using a should 620 for instance. In at least one embodiment, the compliance is a degree or angle 322 of tilt away from a vertical axis 320 of the wash-out hole. Further, the compliance discussed herein is a degree 322 of tilt away from a vertical axis 320 of the wash-out hole and is a measure determined based in part on a ratio of a sum of the top clearance 606 and the bottom clearance 608 to a length (in callout or excerpt 610) of the contact between the pivot surface 614 and the pivot shoulder 612.

Further, even though illustrated with a gap in the callout or excerpt 610 of FIG. 6, the contact is so-called because the pivot surface 614 and the pivot shoulder 612 are touching each other at different points or all throughout the surface and shoulder noted.

In at least one embodiment, the top clearance and the bottom clearance are less than a first determined value and the degree of the tilt is less than a second determined value. Further, the first determined value and the second determined value are associated with an alignment of the wash-out hole.

In at least one embodiment, the contact between the pivot surface and the pivot shoulder is over an annular conical surface. For example, both, the pivot surface 614 and the pivot shoulder 612 are slanted or angled surfaces and are also annular, thereby forming conical surfaces. The slanted or angled surfaces are such that the well insert sleeve 304 cannot sit flush with the guide sleeve 504. This at least allows the movement referenced herein, in an angular 322 manner for the well insert sleeve and its connected components thereon.

In at least one embodiment, a system to enable compliance of a well insert sleeve 304 herein includes a guide sleeve 504 to be used with the well insert sleeve for a wash-out hole. The guide sleeve 504 has a clearance 606, 608 and a contact (generally referenced in callout or excerpt 610) relative to the well insert sleeve 304. The clearance 606, 608 and the contact 610 can enable the compliance of the well insert sleeve in an angular 322 manner relative to a vertical axis 320 of a wash-out hole.

In at least one embodiment, the system can include at least one shear pin 306 that is associated between the guide sleeve 504 and the well insert sleeve 304. The shear pin 306 can shear, upon thermal expansion of a well associated with the well insert sleeve 304. The well insert sleeve 304 is also enabled to move upward upon the shearing of the shear pin 306. A mounting sleeve 506 may be associated with the at least one sheer pin 306. For example, the shear pin 306 can project from the well insert sleeve 304 and can traverse the mounting sleeve 506, as well as the guide sleeve 504. The shear pin 306 may be fixed to the template structure.

A system of a well insert sleeve that is compliant can also include a mounting sleeve 506 that is fixedly attached to a template structure of a subsea template manifold system. Further, the guide sleeve 504 and the well insert sleeve 304 are removably associated with the mounting sleeve 506 by way of the shear pin 306.

In at least one embodiment, a further system to enable compliance of a well insert sleeve herein includes a guide sleeve 504 to be used with the well insert sleeve 304 for a wash-out hole. The guide sleeve 504 has a clearance 606,608 and has a contact 610 relative to the well insert sleeve 304. The clearance and the contact can enable the compliance of the well insert sleeve 304 in an angular 322 manner relative to a vertical axis 320 of a wash-out hole.

In at least one embodiment, the system can include a mounting plate 406 for an Xmas tree flowline connector. The mounting plate 406 is associated with the well insert sleeve 304 to enable a movement that is associated with the compliance of the well insert sleeve 304. Further, an Xmas tree flowline connector 110 can be installed on the mounting plate 406. A separation between the Xmas tree flowline connector 110 or an Xmas tree and the wellhead 402 is ensured in an installation condition that includes the well insert sleeve 304 being offset from a vertical axis 320 of the wash-out hole.

In at least one embodiment, yet another system to enable compliance of a well insert sleeve includes a guide sleeve 504 to be used with the well insert sleeve 304 for a wash-out hole. The guide sleeve 504 has a clearance 606, 608 and a contact 610 relative to the well insert sleeve 304. The clearance and the contact can enable the compliance of the well insert sleeve in an angular 322 manner relative to a vertical axis 320 of a wash-out hole.

The system also includes a wash-out sleeve 410 that has a determined length to enable cement application to fixedly associate the conductor 412 within the wash-out hole 408 and to prevent the cement application from fixedly associating the conductor 412 with the template structure 310 of a subsea template manifold system.

In at least one embodiment, an Xmas tree flowline connector 110 can be installed on the mounting plate 406. A separation between the Xmas tree flowline connector 110 and the wellhead 402 is ensured in an installation condition where the well insert sleeve 304 is offset from a vertical axis 320 of the wash-out hole 408.

Figure 7:
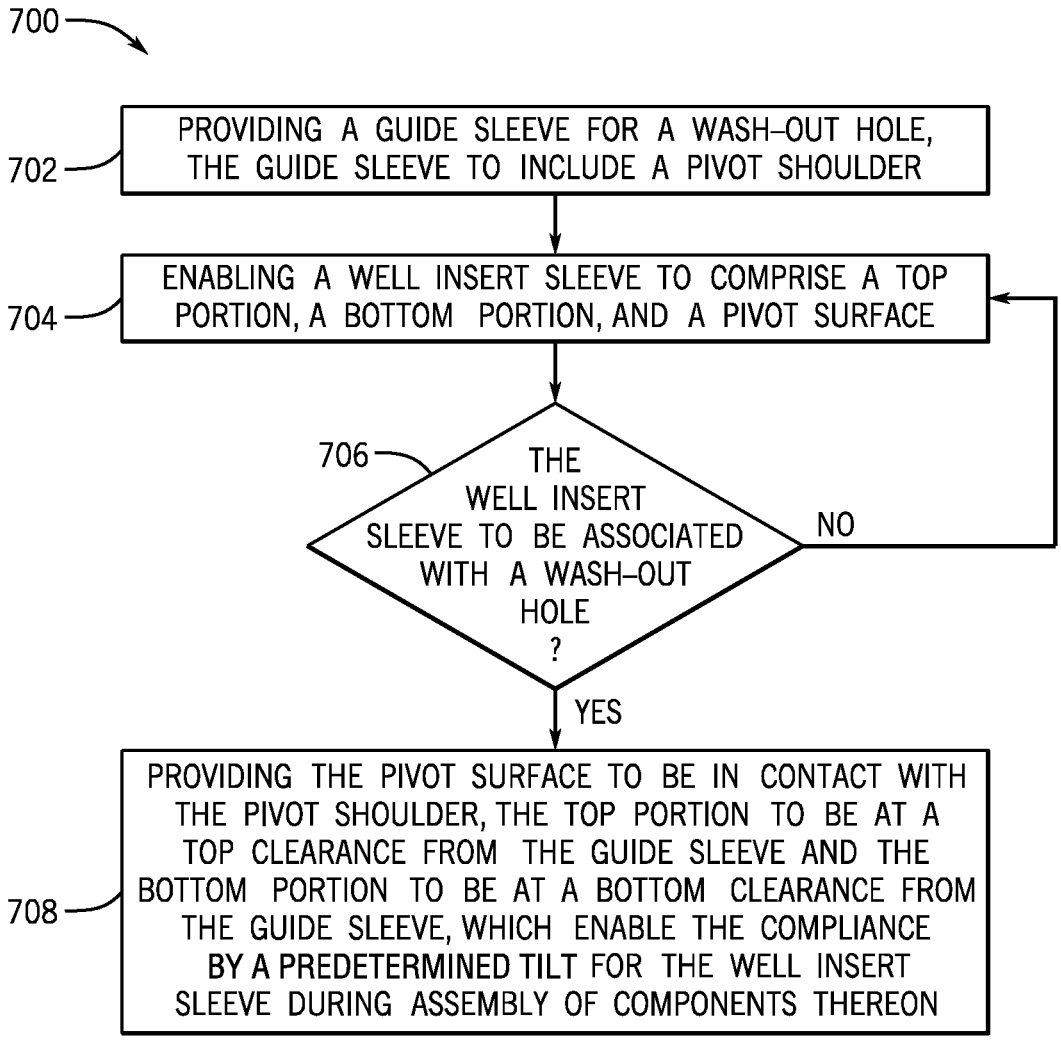
FIG. 7 illustrates a process flow for an example system as described with respect to one or more of FIGS. 3-6, in accordance with at least one embodiment.

FIG. 7 illustrates a process flow 700 for an example system as described with respect to one or more of FIGS. 3-6, in accordance with at least one embodiment. The process flow or method 700 is to enable compliance of a well insert sleeve. The method 700 includes providing (702) a guide sleeve within a wash-out hole, the guide sleeve to include a pivot shoulder. The method 700 includes enabling (704) the well insert sleeve to include a top portion, a bottom portion, and a pivot surface. A step or sub-step 706 may be performed to determine if the well insert sleeve is to be associated with a wash-out hole. For example, a determination can be made to install the well insert sleeve for a template structure of a subsea template manifold system located over a wash-out hole. When in the affirmative, step 708 may be performed, otherwise step 704 may be repeated.

In at least one embodiment, the method 700 includes providing (708) a pivot surface of a well insert sleeve to be in contact with the pivot shoulder of the guide sleeve, providing (708) the top portion to be at a top clearance from the guide sleeve, and providing (708) the bottom portion to be at a bottom clearance from the guide sleeve. Further, even if noted as three aspects, the providing (708) feature is one step that is enabled when the pivot surface of a well insert surface contacts the pivot shoulder of the guide sleeve that also enables the clearances to exist. As a result, in step 708, the top clearance, the bottom clearance, and the contact enable the compliance in an angular manner for the well insert sleeve during assembly of components thereon because the well insert sleeve can move into the clearances while pivoting on the pivot shoulder of the guide sleeve.

The method 700 may include a further step or sub-step for installing a conductor with an offset (or angled) into the wash-out hole. The offset is an angle from a vertical axis of the wash-out hole. The top clearance, the bottom clearance, and the contact between the pivot surface and the pivot shoulder enable the compliance of the well insert sleeve to accommodate the offset.

The method 700 may include a further step or sub-step for installing a wellhead housing and a wellhead with a conductor. Then, one or more of the wellhead housing, the wellhead, and the conductor may be installed with an offset into the wash-out hole. The offset is from a vertical axis of the wash-out hole. The top clearance, the bottom clearance, and the contact of a surface between the pivot surface and the pivot shoulder enable the compliance of the well insert sleeve to accommodate the offset. The method 700 can include a further step or sub-step for providing a mounting sleeve between the guide sleeve and the well insert sleeve. The mounting sleeve can allow the guide sleeve to rest thereon.

The specification and drawings are, accordingly, to be regarded in an illustrative rather than a restrictive sense. It will, however, be evident that various modifications and changes may be made thereunto without departing from the broader spirit and scope of the invention as set forth in the claims. Further, any of the many embodiments disclosed here may be combined by a person of ordinary skill using the present disclosure to understand the effects of such combinations.

What is claimed is:

1. A system to enable compliance of a well insert sleeve, the system comprising:

a guide sleeve to be associated with a wash-out hole, the guide sleeve to include a pivot shoulder; and the well insert sleeve comprising a top portion, a bottom portion, and a pivot surface between the top portion and the bottom portion, the pivot surface to be in contact with the pivot shoulder, wherein the top portion is parallel to a vertical axis of the wash-out hole and comprises a top clearance between the well insert sleeve and the guide sleeve, wherein the bottom portion is parallel to the vertical axis and comprises a bottom clearance between the well insert sleeve and the guide sleeve, wherein the top clearance and the bottom clearance are horizontal clearances with respect to the vertical axis, and wherein the top clearance, the bottom clearance, and the contact enable the compliance by a predetermined tilt for the well insert sleeve during assembly of components thereon.

2. The system of claim 1, further comprising:

a conductor to be installed with an offset into the wash-out hole, wherein the offset is from the vertical axis of the wash-out hole, and wherein the compliance of the well insert sleeve is to accommodate the offset.

3. The system of claim 1, further comprising:

a wellhead housing and a wellhead to be installed with a conductor, one or more of the wellhead housing, the wellhead, and the conductor to be installed with an offset into the wash-out hole, wherein the offset is from the vertical axis of the wash-out hole, and wherein the compliance of the well insert sleeve is to accommodate the offset.

4. The system of claim 1, further comprising:

a mounting sleeve to be fixedly associated with a template structure of a subsea template manifold system, the mounting sleeve to allow the guide sleeve to rest thereon and to be associated together with the guide sleeve and the well insert sleeve via a shear pin.

5. The system of claim 1, wherein the compliance is a degree of tilt away from the vertical axis of the wash-out hole.

6. The system of claim 1, wherein the compliance is a degree of tilt away from the vertical axis of the wash-out hole and is a measure determined based in part on a ratio of a sum of the top clearance and the bottom clearance to a length of the contact between the pivot surface and the pivot shoulder.

7. The system of claim 6, wherein the top clearance and the bottom clearance are less than a first determined value and the degree of the tilt is less than a second determined value, the first determined value and the second determined value associated with an alignment of the wash-out hole.

8. The system of claim 1, wherein the contact between the pivot surface and the pivot shoulder is over an annular conical surface.

9. A system to enable compliance of a well insert sleeve, the system comprising:

a guide sleeve to be used with the well insert sleeve for a wash-out hole, the guide sleeve associated with at least two clearances relative to a vertical portion of the well insert sleeve, wherein the vertical portion is parallel to a vertical axis of the wash-out hole, and wherein the guide sleeve further associated with a contact relative to the well insert sleeve, wherein a first of the at least two clearances is above the contact and wherein a second of the at least two clearances is below the contact, wherein the at least two clearances are horizontal clearances to the vertical axis, and wherein the contact is to enable the compliance of the well insert sleeve by a predetermined tilt relative to the vertical axis of the wash-out hole; and at least one shear pin associated between the guide sleeve and the well insert sleeve, the shear pin extending horizontally, with respect to the vertical axis, from the well insert sleeve and to shear upon thermal expansion of a well associated with the well insert sleeve.

10. The system of claim 9, further comprising:

the well insert sleeve enabled to move upward upon the shearing of the shear pin.

11. The system of claim 9, further comprising:

a mounting sleeve to be associated with the at least one shear pin, the shear pin to traverse the mounting sleeve and the guide sleeve.

12. The system of claim 9, wherein a mounting sleeve is fixedly attached to a template structure of a subsea template manifold system and wherein the guide sleeve, the well insert sleeve, and the mounting sleeve are removably associated together by the shear pin.

13. A system to enable compliance of a well insert sleeve, the system comprising:

a guide sleeve to be used with the well insert sleeve for a wash-out hole, the guide sleeve associated with at least two clearances relative to a vertical portion of the well insert sleeve, wherein the vertical portion is parallel to a vertical axis of the wash-out hole, and wherein the guide sleeve further associated with a contact relative to the well insert sleeve, wherein a first of the at least two clearances is above the contact and wherein a second of the at least two clearances is below the contact, wherein the at least two clearances are horizontal clearances to the vertical axis, and wherein the contact is to enable the compliance of the well insert sleeve by a predetermined tilt relative to the vertical axis of the wash-out hole; and a mounting plate for an Xmas tree flowline connector, the mounting plate associated with the well insert sleeve to enable a movement that is associated with the compliance of the well insert sleeve.

14. The system of claim 13, further comprising:

an Xmas tree flowline connector to be installed on the mounting plate, wherein a separation between the Xmas tree flowline connector and a wellhead is ensured in an installation condition comprising the well insert sleeve being offset from the vertical axis of the wash-out hole.

15. A system to enable compliance of a well insert sleeve, the system comprising:

a guide sleeve to be used with the well insert sleeve for a wash-out hole, the guide sleeve associated with at least two clearances relative to a vertical portion of the well insert sleeve, wherein the vertical portion is parallel to a vertical axis of the wash-out hole, and wherein the guide sleeve further associated with a contact relative to the well insert sleeve, wherein a first of the at least two clearances is above the contact and wherein a second of the at least two clearances is below the contact, wherein the at least two clearances are horizontal clearances to the vertical axis, and wherein the contact is to enable the compliance of the well insert sleeve by a predetermined tilt relative to the vertical axis of the wash-out hole; and a wash-out sleeve comprising a length to enable cement application to fixedly associate a conductor within the wash-out hole and to prevent the cement application from fixedly associating the conductor with a template structure of a subsea template manifold system.

16. The system of claim 15, further comprising:

an Xmas tree flowline connector to be installed on a mounting plate, wherein a separation between the Xmas tree flowline connector and a wellhead is ensured in an installation condition comprising the well insert sleeve being offset from the vertical axis of the wash-out hole.

17. A method to enable compliance of a well insert sleeve, the method comprising:

providing a guide sleeve in association with a wash-out hole, the guide sleeve to include a pivot shoulder; and enabling the well insert sleeve to comprise a top portion, a bottom portion, and a pivot surface between the top portion and the bottom portion, the pivot surface to be in contact with the pivot shoulder, wherein the top portion is parallel to a vertical axis of the wash-out hole and comprises a top clearance between the well insert sleeve and the guide sleeve, wherein the bottom portion is parallel to the vertical axis and comprises a bottom clearance between the well insert sleeve and the guide sleeve, wherein the top clearance and the bottom clearance are horizontal clearances with respect to the vertical axis, and wherein the top clearance, the bottom clearance, and the contact enable the compliance by a predetermined tilt for the well insert sleeve during assembly of components thereon.

18. The method of claim 17, further comprising:

installing a conductor with an offset into the wash-out hole, wherein the offset is from the vertical axis of the wash-out hole, and wherein the top clearance, the bottom clearance, and the contact enable the compliance of the well insert sleeve to accommodate the offset.

19. The method of claim 17, further comprising:

installing a wellhead housing and a wellhead with a conductor, one or more of the wellhead housing, the wellhead, and the conductor installed with an offset into the wash-out hole, wherein the offset is from the vertical axis of the wash-out hole, and wherein the top clearance, the bottom clearance, and the contact enable the compliance of the well insert sleeve to accommodate the offset.

20. The method of claim 17, further comprising:

providing a mounting sleeve between the guide sleeve and the well insert sleeve, the mounting sleeve to allow the guide sleeve to rest thereon.

* * * * *